US009091061B2

(12) United States Patent
Dincel

(10) Patent No.: US 9,091,061 B2
(45) Date of Patent: Jul. 28, 2015

(54) BUILDING ELEMENT FOR A STRUCTURAL BUILDING PANEL

(76) Inventor: Burak Dincel, Sydney (AU)

( * ) Notice: Subject to any disclaimer, the term of this patent is extended or adjusted under 35 U.S.C. 154(b) by 0 days.

(21) Appl. No.: 14/110,737

(22) PCT Filed: Apr. 10, 2012

(86) PCT No.: PCT/AU2012/000358

§ 371 (c)(1), (2), (4) Date: Oct. 21, 2013

(87) PCT Pub. No.: WO2012/139153

PCT Pub. Date: Oct. 18, 2012

(65) Prior Publication Data

US 2014/0026509 A1 Jan. 30, 2014

(30) Foreign Application Priority Data

Apr. 11, 2011 (AU) ..... 2011901361

(51) Int. Cl.

| | |
|---|---|
| ***E04B 2/86*** | (2006.01) |
| ***E04B 1/00*** | (2006.01) |
| ***E04B 1/14*** | (2006.01) |
| ***E04C 2/20*** | (2006.01) |
| ***E04C 2/32*** | (2006.01) |
| ***E04C 2/34*** | (2006.01) |

(52) U.S. Cl.

CPC ..... *E04B 2/86* (2013.01); *E04B 1/0007* (2013.01); *E04B 1/14* (2013.01); *E04C 2/20* (2013.01); *E04C 2/328* (2013.01); *E04C 2/34* (2013.01); *E04B 2/8629* (2013.01)

(58) Field of Classification Search

CPC ..... E04B 1/0007; E04B 1/14; E04B 2/86; E04B 2/8629; E04C 2/20; E04C 2/328; E04C 2/34

USPC ..... 52/426, 429, 433, 439

See application file for complete search history.

(56) References Cited

U.S. PATENT DOCUMENTS

| | | | | | |
|---|---|---|---|---|---|
| 2,205,730 | A | * | 6/1940 | Morgan | 52/204.1 |
| 3,440,785 | A | * | 4/1969 | Denny et al. | 52/275 |
| 3,460,304 | A | * | 8/1969 | Glaza et al. | 52/588.1 |
| 3,555,751 | A | * | 1/1971 | Thorgusen | 52/127.3 |
| 3,742,672 | A | * | 7/1973 | Schaeufele | 52/592.1 |
| 3,815,311 | A | * | 6/1974 | Nisula et al. | 52/579 |
| 3,828,502 | A | * | 8/1974 | Carlsson | 52/309.11 |
| 4,104,837 | A | * | 8/1978 | Naito | 52/579 |

(Continued)

FOREIGN PATENT DOCUMENTS

| | | | |
|---|---|---|---|
| WO | 2005/088020 | A1 | 9/2005 |
| WO | WO 2009059410 | A1 * | 5/2009 |

OTHER PUBLICATIONS

International Preliminary Report on Patentability for PCT/AU2012/000358 dated Oct. 15, 2013 (6 pages).*

(Continued)

*Primary Examiner* — Rodney Mintz

(74) *Attorney, Agent, or Firm* — Ladas & Parry LLP

(57) ABSTRACT

A building element that is an elongated extrusion of plastics material. The element can be used to form straight or curved walls. A number of elements are secured together by transverse relative movement and snap engagement of flanges in a recess. In one embodiment the element has a longitudinally extending seal projection that aids in sealingly connecting engaged elements.

2 Claims, 4 Drawing Sheets

(56) References Cited

U.S. PATENT DOCUMENTS

| | | | | | |
|---|---|---|---|---|---|
| 4,236,366 | A | * | 12/1980 | Rijnders | 52/580 |
| 4,299,070 | A | * | 11/1981 | Oltmanns et al. | 52/309.11 |
| 4,433,522 | A | * | 2/1984 | Yerushalmi | 52/426 |
| 4,438,614 | A | * | 3/1984 | Raith et al. | 52/580 |
| 4,550,539 | A | * | 11/1985 | Foster | 52/236.1 |
| 4,884,382 | A | * | 12/1989 | Horobin | 52/426 |
| 4,967,528 | A | * | 11/1990 | Doran | 52/309.12 |
| 5,216,863 | A | * | 6/1993 | Nessa et al. | 52/439 |
| 5,274,975 | A | * | 1/1994 | Haag | 52/300 |
| 5,293,728 | A | * | 3/1994 | Christopher et al. | 52/588.1 |
| 5,311,718 | A | * | 5/1994 | Trousilek | 52/425 |
| 5,404,686 | A | * | 4/1995 | Esposito | 52/588.1 |
| 5,465,545 | A | | 11/1995 | Trousilek | |
| 5,553,430 | A | * | 9/1996 | Majnaric et al. | 52/236.8 |
| 5,608,999 | A | * | 3/1997 | McNamara | 52/275 |
| 5,706,620 | A | * | 1/1998 | De Zen | 52/220.2 |
| 5,729,944 | A | | 3/1998 | De Zen | |
| 5,735,090 | A | * | 4/1998 | Papke | 52/220.2 |
| 5,740,648 | A | * | 4/1998 | Piccone | 52/426 |
| 5,768,851 | A | * | 6/1998 | Nagaoka | 52/790.1 |
| 5,953,880 | A | * | 9/1999 | De Zen | 405/257 |
| 5,974,751 | A | * | 11/1999 | De Zen | 52/439 |
| 6,021,646 | A | * | 2/2000 | Burley et al. | 62/235 |
| 6,105,315 | A | * | 8/2000 | Stoecklein et al. | 52/134 |
| 6,167,669 | B1 | | 1/2001 | Lanc | |
| 6,189,269 | B1 | * | 2/2001 | De Zen | 52/220.5 |
| 6,212,845 | B1 | * | 4/2001 | De Zen | 52/607 |
| 6,219,984 | B1 | * | 4/2001 | Piccone | 52/426 |
| 6,247,280 | B1 | * | 6/2001 | Grinshpun et al. | 52/309.12 |
| 6,324,796 | B1 | | 12/2001 | Heath | |
| 6,435,471 | B1 | * | 8/2002 | Piccone | 249/47 |
| 6,658,808 | B1 | * | 12/2003 | Doherty et al. | 52/580 |
| 6,694,692 | B2 | * | 2/2004 | Piccone | 52/426 |
| 7,444,788 | B2 | * | 11/2008 | Morin et al. | 52/425 |
| 7,559,176 | B2 | * | 7/2009 | Foell et al. | 52/425 |
| 7,628,570 | B2 | * | 12/2009 | Davidsaver et al. | 405/284 |
| 7,703,248 | B2 | * | 4/2010 | Dincel | 52/284 |
| 7,797,897 | B2 | * | 9/2010 | Roth | 52/282.3 |
| 8,033,759 | B2 | * | 10/2011 | Davidsaver et al. | 405/284 |
| 8,322,115 | B2 | * | 12/2012 | Foell et al. | 52/855 |
| 8,458,985 | B2 | * | 6/2013 | Richardson et al. | 52/745.21 |
| 8,555,590 | B2 | * | 10/2013 | Richardson et al. | 52/426 |
| 8,782,984 | B2 | * | 7/2014 | Foell et al. | 52/439 |
| 8,793,953 | B2 | * | 8/2014 | Richardson et al. | 52/429 |
| 2002/0088194 | A1 | * | 7/2002 | Ray | 52/439 |
| 2003/0009967 | A1 | * | 1/2003 | Piccone | 52/426 |
| 2004/0244321 | A1 | * | 12/2004 | Dincel | 52/503 |
| 2005/0016083 | A1 | * | 1/2005 | Morin et al. | 52/79.14 |
| 2005/0016103 | A1 | * | 1/2005 | Piccone | 52/481.1 |
| 2006/0032172 | A1 | * | 2/2006 | Foell et al. | 52/426 |
| 2006/0213140 | A1 | * | 9/2006 | Morin et al. | 52/426 |
| 2007/0175146 | A1 | * | 8/2007 | Carlisle | 52/426 |
| 2010/0071304 | A1 | * | 3/2010 | Richardson et al. | 52/699 |
| 2010/0212241 | A1 | | 8/2010 | Holroyd | |
| 2010/0251657 | A1 | * | 10/2010 | Richardson et al. | 52/588.1 |
| 2011/0107702 | A1 | * | 5/2011 | Koikas et al. | 52/426 |
| 2012/0056344 | A1 | * | 3/2012 | Richardson et al. | 264/35 |
| 2014/0157705 | A1 | * | 6/2014 | Richardson et al. | 52/429 |
| 2014/0318062 | A1 | * | 10/2014 | Richardson et al. | 52/309.1 |

OTHER PUBLICATIONS

Supplementary European Search Report dated Aug. 1, 2014 for Application No. EP 12 77 1974.

First Examination Report dated Aug. 8, 2014 for New Zealand Application No. 616262.

* cited by examiner

BUILDING ELEMENT FOR A STRUCTURAL BUILDING PANEL

RELATED APPLICATION INFORMATION

This application is a 371 of International Application PCT/AU2012/000358 filed 10 Apr. 2012 entitled "A Building Element For A Structural Building Panel", which was published in the English language on 18 Oct. 2012, with International Publication Number WO 2012/139153 A1, and which claims priority from Australian Application No. 2011901361 filed 11 Apr. 2011, the content of which is incorporated herein by reference.

TECHNICAL FIELD

The present invention relates to elongated hollow building elements that are combined to form a wall or panel and more particularly to such building elements that are extruded for plastics material and are secured together by snap engagement. The building elements can be used in the construction of basement walls, liquid and granular storage tanks and other like structures.

BACKGROUND OF THE INVENTION

The present invention relates to the building element described in U.S. Pat. No. 7,703,248.

Where walls are exposed to moisture, such as walls of water storage tanks and building walls below ground level, typically waterproofing is applied to the walls that are exposed to the moisture. In the construction of conventional concrete and reinforced masonry walls, the walls need to be protected from moisture as exposure to moisture over time will cause degradation of the concrete and corrosion of the steel. A still further problem is mould, mildew and fungus and bacterial development on the walls. To address this issue typically a waterproof membrane is applied to inhibit water reaching the concrete or reinforced masonry wall. It is not unusual to provide a gap between an earth surface and the wall to enable a water proofing membrane to be applied. Typically the gap can be 40 inches. This gap can be considered a safety issue for workers.

The above construction of walls that are to exist in a damp environment has a number of disadvantages in that if the waterproofing fails then the wall will degrade. A further disadvantage is the loss of floor area should a gap be required between the wall and an earth surface.

OBJECT OF THE INVENTION

It is the object of the present invention to overcome or substantially ameliorate at least one of the above disadvantages.

SUMMARY OF THE INVENTION

There is disclosed herein an extruded hollow longitudinally elongated building element into which concrete is to be poured, the element being extruded so as to be integrally formed and comprising:

a pair of longitudinally extending spaced walls which are generally longitudinally coextensive and longitudinally parallel;

a plurality of longitudinally extending spaced transverse webs joining the side walls, the webs including a first and a second web;

a pair of longitudinally extending grooves, each of the grooves being formed in a respective one of the side walls;

a pair of longitudinally extending end flanges, each of the end flanges extending from a respective one of the walls;

a pair of longitudinally surfaces that diverge from the first web toward the grooves;

a sealing projection extending from each flange and extending longitudinally thereof; and wherein the end flanges and grooves are positioned and configured to engage a respective one of the grooves of a respective one of the flanges of a like element, and the end flanges are resilient deformed by engagement longitudinal surface of the like element so as to be resilient deformed such that, when the end flanges are moved in a transverse direction relative to the diverging surfaces of the like element, there is a resilient deformation of the end flanges to allow snap engagement of each end flange in a respective one of the grooves to thereby secure the elements together by snap engagement, and the sealing projections extend transversely from their associated flange toward the other element to aid in sealingly connecting the elements.

Preferably, each end flange includes a first portion extending transversely from the first wall, and a second portion extending generally transverse relative to the first portion so as to project into the associated groove of the like element.

In one preferred form, said sealing element projects from said portion.

In a further preferred form, said sealing projection extends from said second portion.

Preferably, each groove is provided by a groove providing portion extending longitudinally of the element, the groove providing portion having a sealing projection extending longitudinally of the element and extending into the groove so as to be operatively associated with the sealing element of the second portion to aid in sealingly connecting the elements.

BRIEF DESCRIPTION OF THE DRAWINGS

Preferred forms of the present invention will now be described by way of example with reference to the accompanying drawings wherein.

DETAILED DESCRIPTION OF THE PREFERRED EMBODIMENTS

Figure 1:
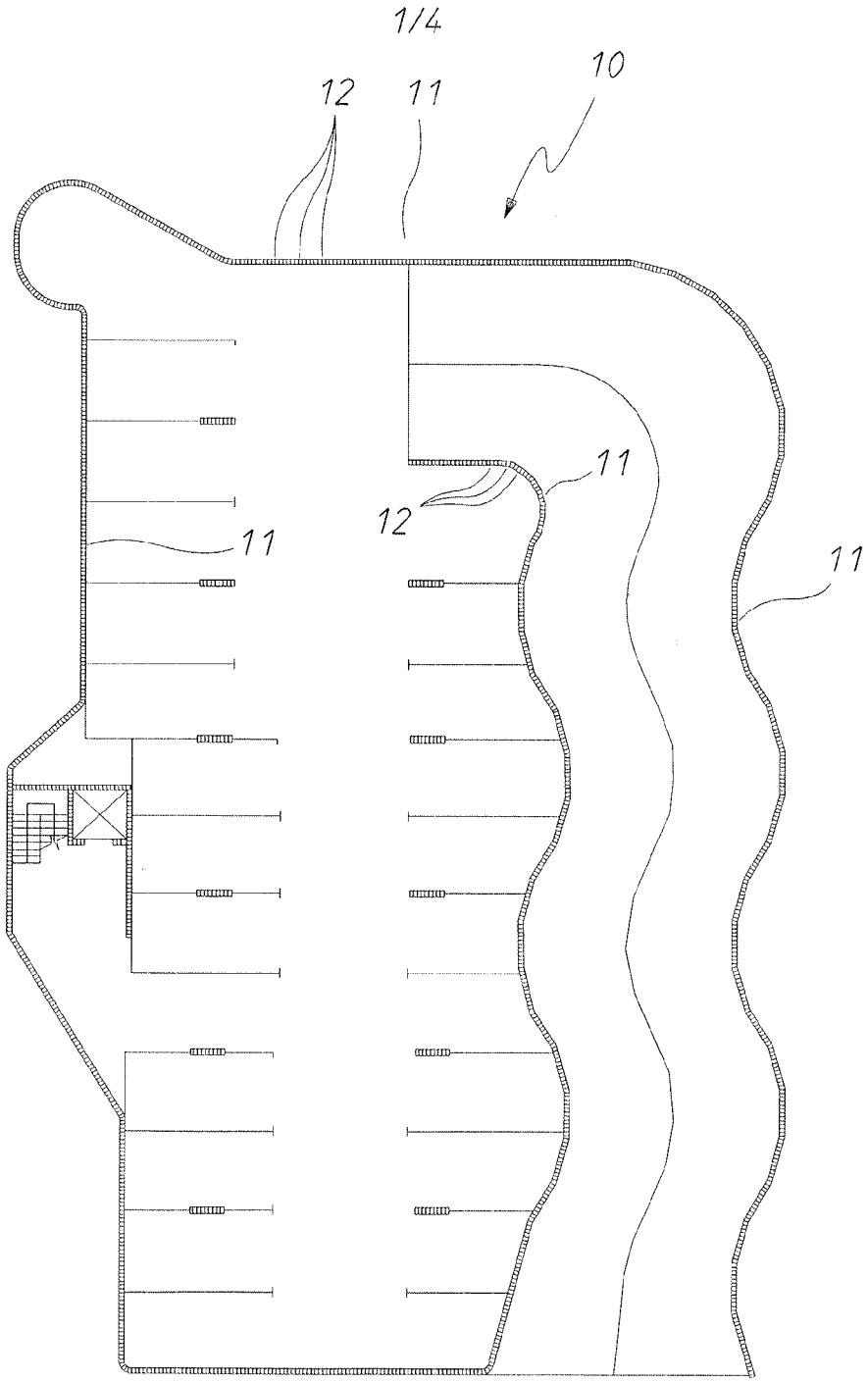
FIG. 1 is a schematic top plan view of the walls of a building basement.
Figure 2:
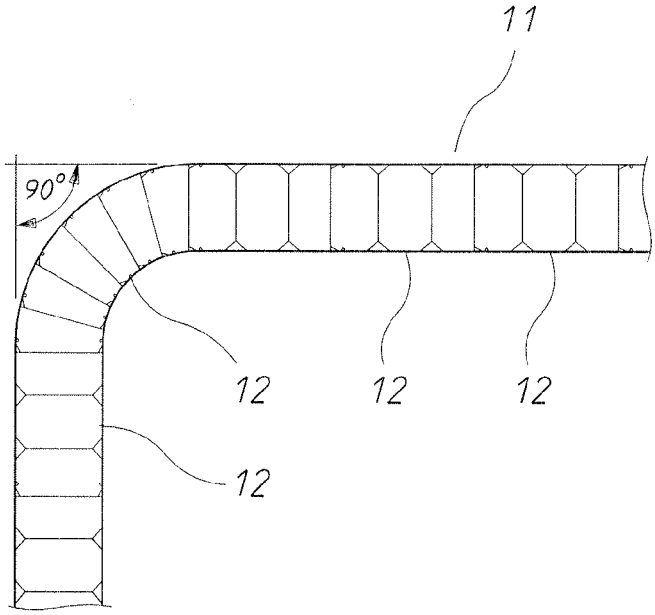
FIG. 2 is a schematic top plan view of portion of one of the walls of FIG. 1.

In FIG. 1 of the accompanying drawings there is schematically depicted the basement 10 of a building. The basement 10 may be below ground level.

Figure 3:
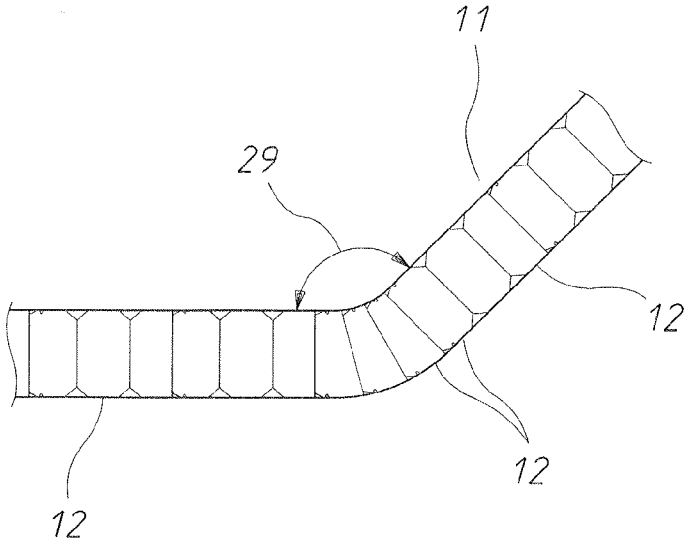
FIG. 3 is a schematic top plan view of a further portion of one of the walls of FIG. 1.
Figure 5:
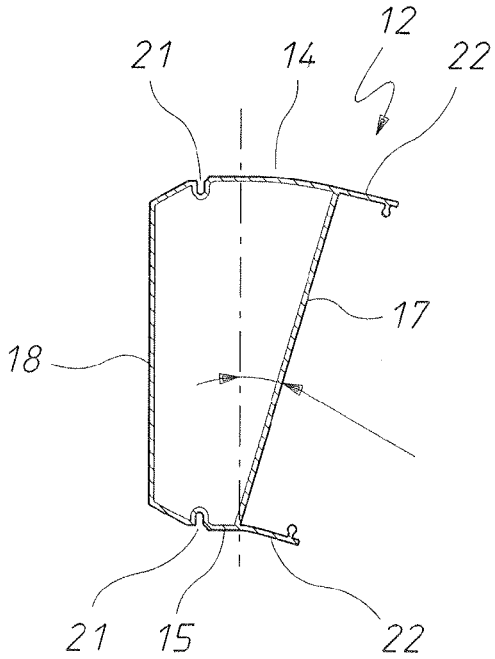
FIG. 5 is a schematic top plan view of a further building element used in forming the walls of FIG. 1.

The basement 10 includes walls 11 that may be straight or curved. Each of the walls 11 is formed by a plurality of elongated building elements 12. Each building element 12 is hollow and is extruded from plastics material. Each element 12 has a pair of longitudinally extending side walls 13 that are longitudinally parallel. In FIG. 3 the element 12 illustrated has the walls 13 also transversely parallel and generally flat. The element 12 of FIG. 5 has longitudinally extending side walls 14 and 15 that provide for the construction of curved walls and corners, with the walls 11 inclined by a desired angle 29. The inner wall 15 is of a shorter transverse width relative to the outer wall 14.

Figure 4:
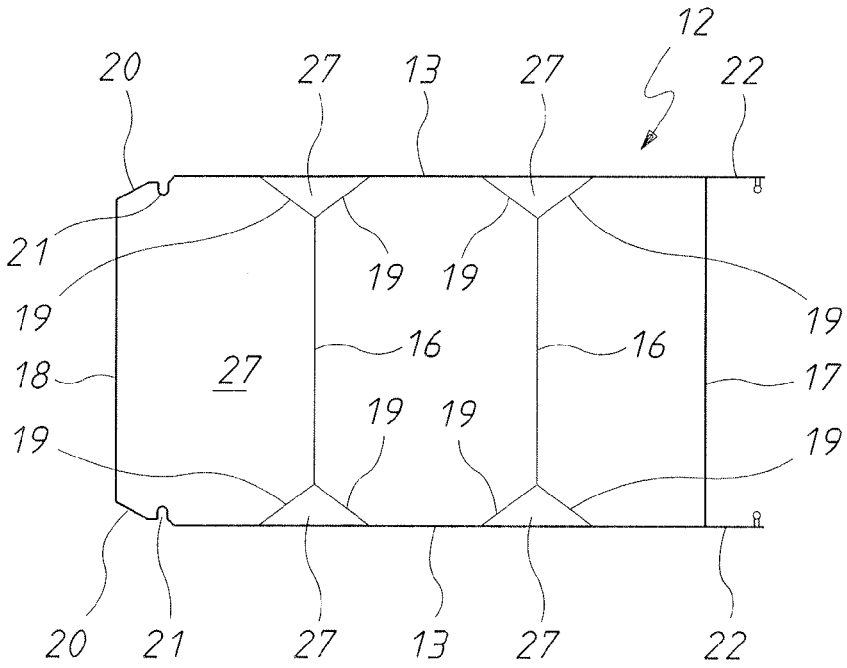
FIG. 4 is a schematic top plan view of a building element used to form the walls of the basement of FIG. 1.

Each of the elements 12 has a plurality of transverse webs 16 and end webs 17 and 18. The webs 16 of the element 12 of FIG. 4 is joined to the side walls 13 by connecting webs 19. The connecting webs 19 are inclined so as to converge from their connection with the side walls 13 to the associated web 16.

The end web 18 has extending from it longitudinally extending ramp surfaces 20 that diverge from the web 18 toward the side walls 13, 14 and 15. The surfaces 20 extend to longitudinally extending grooves 21.

Extending from the end web 17 are flanges 22 that in the embodiment of FIG. 4 are generally parallel and coextensive.

The elements 12 are connected by transverse relative movement between the elements 12. In particular the flanges 22 of one of the elements 12 moves transversely across the surfaces 20 so as to be resiliently deflected apart, with the flanges 22 then snap, engaging within the recesses 21 to thereby adjacent elements 12 that are adjacent.

Figure 6:
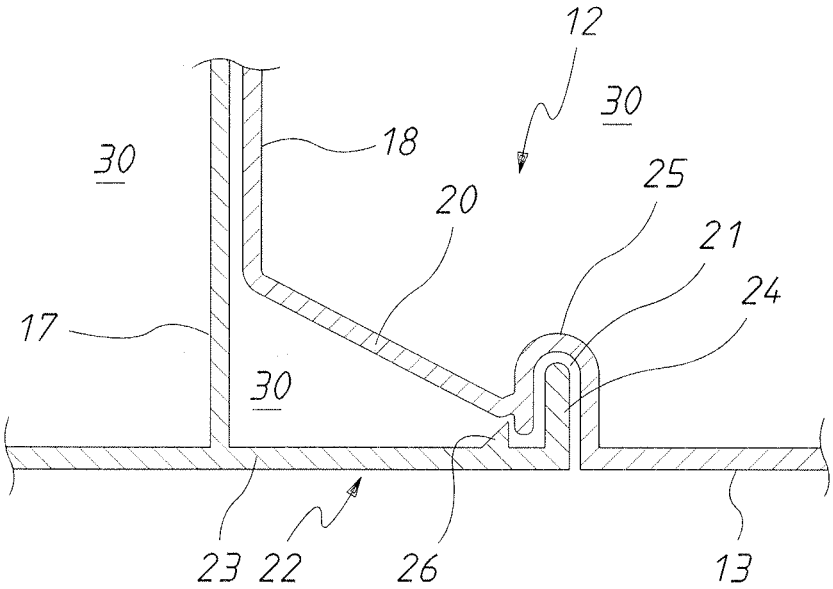
FIG. 6 is a schematic enlarged view of portion of the elements used to form the walls of FIG. 1.
Figure 7:
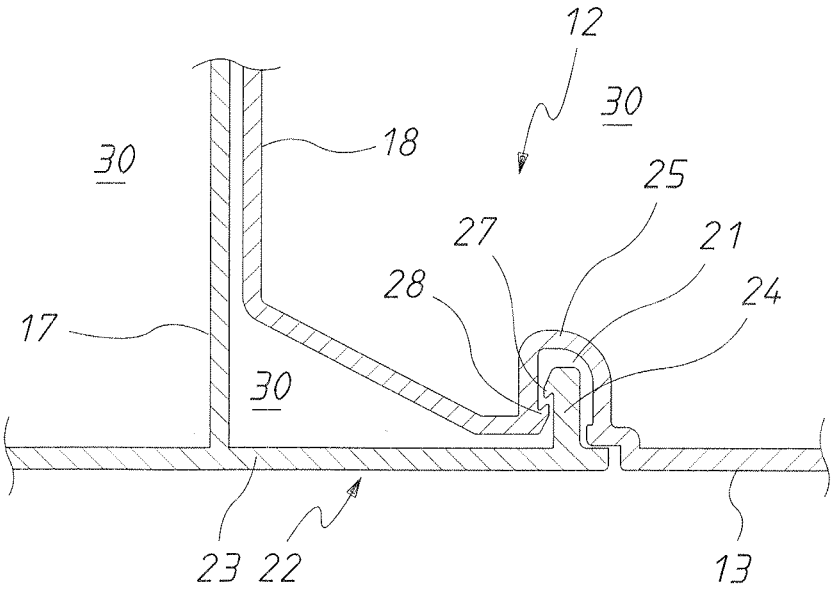
FIG. 7 is a schematic top plan view of an alternative portion of FIG. 6.

As best seen in FIGS. 6 and 7 each flange 22 includes a first flange portion 23 that extends from the web 17, and a second flange portion 24 that extends from the first flange portion 23. The second portion 24 is to be located in the recess 21. The portions 23 of each element 12 are generally parallel and coextensive and extend generally transverse to the associated web 17. The second portion 26 projects from the first portion 23 in a direction generally parallel to the web 17.

Each groove 21 is provided by a groove providing portion 25, the portions 25 of each element 12 being generally parallel and coextensive. The portions 25 are of a "U" shaped transverse cross section so as to receive the portion 24.

In the embodiment of FIG. 6, the first flange portion 23 is provided with a longitudinally extending seating projection 26 that is shaped like a barb. The projection 26 extends from the first portion 23 toward the adjacent one of elements 12. The projection 26 may actually engage the element 12 that is adjacent or be slightly spaced therefrom. In such instances, wet concrete delivered to the cavities 30 would sealingly connect each sealing projection 26 to the element 12 that is adjacent. The projection 26 aids in sealingly connecting engaged elements 12.

When elements 12, as shown in FIG. 6, are connected, the second portion 24 would move along the surface 20 so as to cause resilient outward deflection of the first portions 22 until the second portions 24 were aligned with the groove 21 so as to snap engage therein.

In the embodiment of FIG. 7, there is provided a pair of sealing projections 27 and 28. The projection 27 extends from the second portion 24 while the projection 28 extends from the recess providing portion 25. The projections 27 and 28 engage, or are located adjacent each other so that the gap therebetween is sealed by wet concrete.

The projections 26, 27 and 28 extend the entire longitudinal length of each of the elements 12.

The invention claimed is:

1. An extruded hollow longitudinally elongated building element into which concrete is to be poured, the building element being extruded so as to be integrally formed and comprising:

a pair of longitudinally, extending spaced side walls which are longitudinally coextensive and longitudinally parallel;

a plurality of longitudinally extending spaced transverse webs joining the side walls, the webs including a first and a second web;

a pair of longitudinally extending grooves, each of the grooves being formed in a respective one of the side walls;

a pair of longitudinally extending end flanges, each of the end flanges extending from a respective one of the side walls;

a pair of longitudinal surfaces that diverge from the first web toward the grooves;

a sealing projection extending from each end flange and extending longitudinally thereof;

wherein the end flanges each include a first portion extending from a respective one of the side walls, and a second portion extending transversely from the first portion, with the second portion of each end flange being positioned and configured to engage a respective one of the grooves of a respective one of the end flanges of a like element, and the end flanges are resiliently deformed by engagement with the longitudinal diverging surfaces of the like element, so that when the end flanges are moved in a transverse direction relative to the longitudinal diverging surfaces of the like element, snap engagement of each end flange is allowed in the respective one of the grooves to thereby secure the building element and the like element together by snap engagement, and with the sealing projection of each end flange extending transversely from the respective one of the end flanges toward the other like element to aid in sealingly connecting the building element and like element;

wherein the sealing projection of each end flange extends from the second portion of that end flange; and wherein the sealing projection is a first sealing projection and each groove is provided by a groove providing portion extending longitudinally of the building element, each groove providing portion having a further sealing projection extending longitudinally of the building element and extending into the respective groove so as to be operatively associated with the first sealing projection of the second portion to aid in sealingly connecting the building element and like element.

2. The building element of claim 1, wherein said transverse webs include a further web located between the first and second webs.

* * * * *